US006919523B1

(12) United States Patent
Lai

(10) Patent No.: US 6,919,523 B1
(45) Date of Patent: Jul. 19, 2005

(54) ELECTRICAL SWITCH

(75) Inventor: Ka Fai Lai, Tsuen Wan (HK)

(73) Assignee: Defond Components Limited, Chaiwan (HK)

( * ) Notice: Subject to any disclaimer, the term of this patent is extended or adjusted under 35 U.S.C. 154(b) by 0 days.

(21) Appl. No.: 10/772,276

(22) Filed: Feb. 6, 2004

(51) Int. Cl.[7] ..... H01H 5/00

(52) U.S. Cl. ..... 200/402; 200/553; 200/339; 200/449

(58) Field of Search ..... 200/401–405, 200/553–560, 1 R, 17 R, 339, 6 C, 449

(56) References Cited

U.S. PATENT DOCUMENTS 4,967,043 A * 10/1990 Killarney ..... 200/1 B
5,597,989 A * 1/1997 Nishio ..... 200/6 R
5,913,415 A * 6/1999 Kishi et al. ..... 200/456
6,080,949 A * 6/2000 Weber et al. ..... 200/437

* cited by examiner

*Primary Examiner*—K. Richard Lee
(74) *Attorney, Agent, or Firm*—Leydig, Voit & Mayer. Ltd.

(57) ABSTRACT

An electrical switch includes a casing having a central and two side chambers that are separated from the central chamber by respective partitions. A switching mechanism in each second chamber has fixed and moving contacts and an actuator. A rocker in the central chamber is used to cause the actuators to move the moving contacts into contact with and out of contact from the fixed contacts. There is also included engaging means engaging each actuator to the rocker for movement thereby, which has a circular part that extends across the first and second chambers rotatably snugly through a circular hole in the partition such that partitioning between the central and side chambers is substantially splash, jet or dust proof.

13 Claims, 2 Drawing Sheets

ELECTRICAL SWITCH

The present invention relates to an electrical switch, especially a rocker switch, that is splash, jet or dust proof.

BACKGROUND OF THE INVENTION

Splash, jet or dust proof electrical switches are generally known, in which various seals are added or sealing methods adopted but they tend to be complicate for assembly and expensive in production. These are often needed even if the degree of splash, jet or dust proof is not required to be too high.

The subject invention seeks to mitigate or at least alleviate such drawbacks by providing an improved electrical switch of this type.

SUMMARY OF THE INVENTION

According to the invention, there is provided an electrical switch including a casing having a first chamber and at least one second chamber which are separated from each other by a partition. A switching mechanism in the second chamber has at least one fixed contact, a moving contact and an actuator for moving the moving contact into contact with and out of contact from the fixed contact. An operator is supported in the first chamber for angular movement between a first position causing the actuator to move the moving contact into contact with the fixed contact and a second position causing the actuator to move the moving contact out of contact from the fixed contact. There is also included engaging means engaging the actuator to the operator for movement thereby, which has a circular part that extends across the first and second chambers rotatably snugly through a circular hole in the partition such that partitioning between the first and second chambers is substantially splash, jet or dust proof.

Preferably, the engaging means comprises a shaft which includes the circular part and fixedly inter-connects the actuator and the operator and about which the actuator and the operator are angularly movable.

It is preferred that the engaging means comprises a shaft which includes the circular part and is an integral part of the actuator extending to and engaging with the operator, about which the actuator and the operator are angularly movable.

Preferably, the first chamber has an opening in which the operator is supported, the operator fully occupying the opening and thus closing the first chamber.

It is preferred that the casing has a side wall that is recessed to define the second chamber.

It is further preferred that the second chamber in closed by a cover which is attached around its edge to the casing, thereby sealing off the second chamber.

In a preferred embodiment, the casing has two said second chambers on opposite sides of the first chamber separated therefrom by respective said partitions and housing respective said switching mechanisms which are simultaneously operable by the operator.

More preferably, the casing has opposite side walls that are recessed to define the respective second chambers.

Further more preferably, the two partitions merges together in the lower half of the casing to form a single central wall between the two second chambers, on which the first chamber is located.

More preferably, the two actuators include respective pins as the engaging means which are co-axially aligned with each other and engage with the operator from opposite directions and about which the actuators and the operator are angularly movable.

In a specific preferred construction, the switching mechanism comprises two said fixed contacts, and the moving contact comprises a contact lever extending across the fixed contacts for contact making and breaking therewith as pivoted by the actuator which acts upon the contact lever via a spring flippable by the actuator through an over-center action.

More specifically, the contact lever has a middle part acted upon by the spring, and the actuator includes two legs positioned on opposite sides of the lever part for pivotal movement to press upon the lever part and thereby tilt the contact lever in opposite directions.

As an example, the electrical switch is a rocker switch, in which the operator comprises a rocker supported for pivotal movement.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
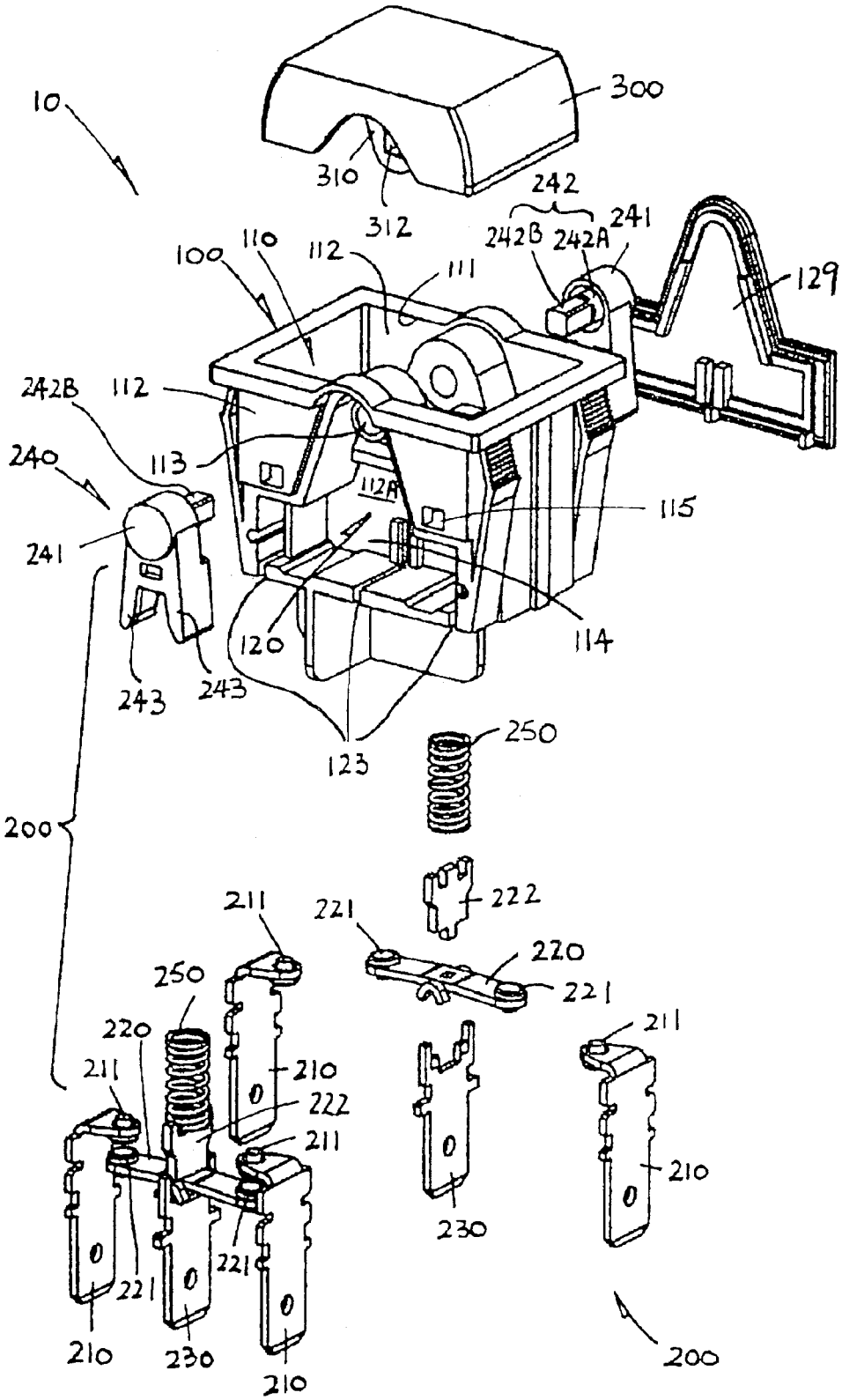
FIG. 1 is an exploded perspective view of an embodiment of an electrical switch in accordance with the invention.
Figure 2:
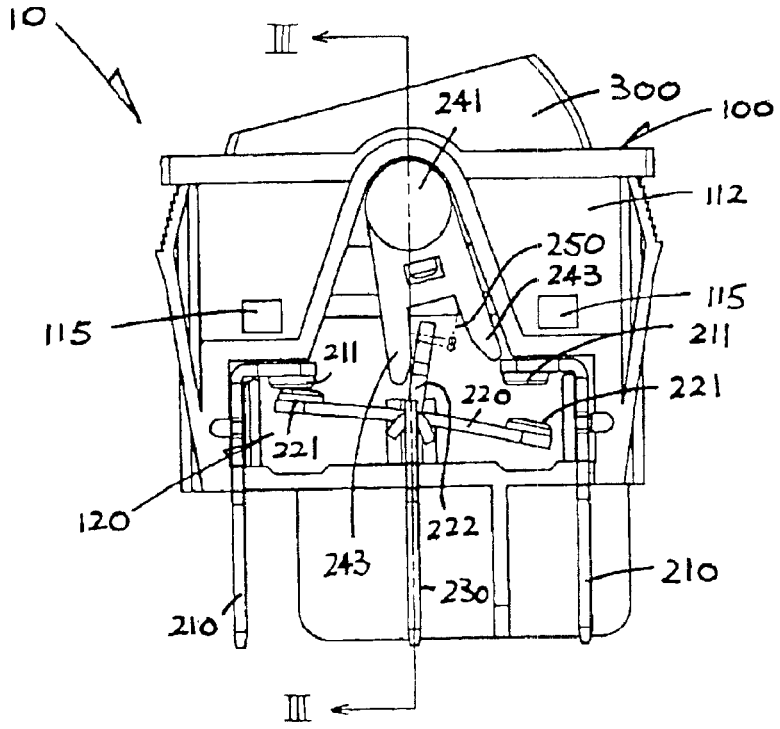
FIG. 2 is a partially open side elevational view of the electrical switch of FIG. 1.
Figure 3:
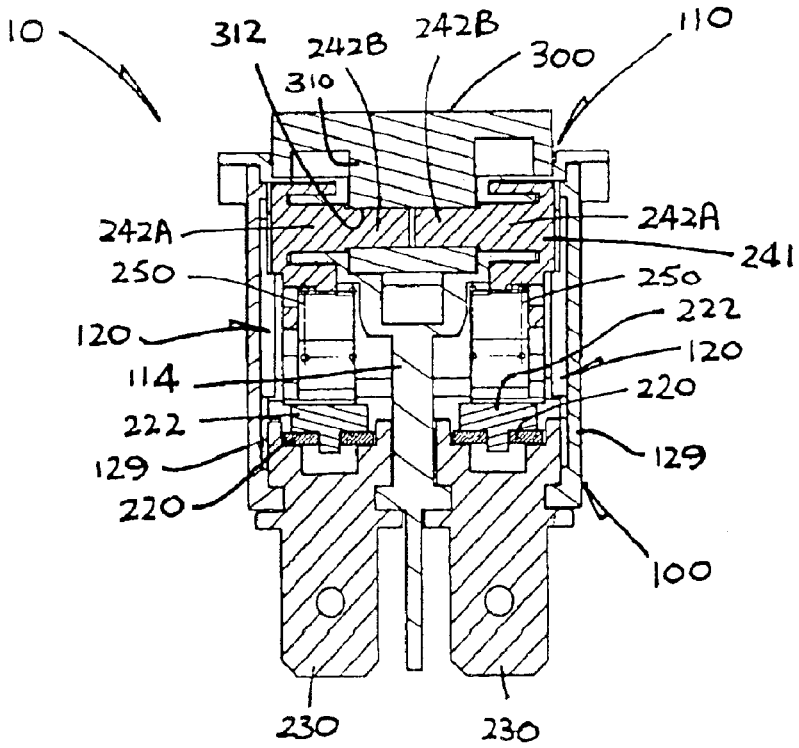
FIG. 3 is a cross-sectional end view of the electrical switch of FIG. 2, taken along line III—III.

Referring to the drawings, there is shown an electrical switch embodying the invention, which is in the form of a rocker switch 10 comprising a rectangular box-like plastic casing 100, a pair of switching mechanisms 200 outside the casing 100 and a plastic operating rocker 300 inside the casing 100 for simultaneously operating both switching mechanisms 200. The casing 100 has a central chamber 110 with a top opening 111 in which the rocker 300 is located, and includes left and right side walls 112 which are in part recessed to define a pair of relatively smaller identical side chambers 120 symmetrically on opposite sides of the central chamber 110 locating the switching mechanisms 200 respectively.

A bottom 310 of the rocker 300 includes a horizontal square through hole 312, by means of which the rocker 300 is hinged for rocking. The rocker 300 fully occupies the top opening 111 and thus closes the central chamber 110. The side chambers 120 are closed by respective vertical covers 129.

The recessed part of each casing wall 112, or more precisely the upper portion of the recessed part, acts as a partition 112A which separates the corresponding side chamber 120 from the central chamber 110 and through which there is an upper central circular hole 113. The two partitions 112A merge together in the lower half of the casing 100 to form a single vertical central wall 114 between the two side chambers 120, right on which there is located the central chamber 110 occupying only about half i.e. the upper half of the casing 100.

Each side chamber 120 together with its cover 129 has an upright isosceles triangular shape, including an apex that encompasses the corresponding hole 113. The cover 129 is attached around its edge to the casing 110 by glue or ultrasonic welding, thereby closing and sealing off the side chamber 120.

Each switching mechanism 200 is formed by two vertical fixed contact strips 210, a horizontal moving contact lever 220 having opposite ends 221 extending across to reach immediately below respective upper ends 211 of the fixed contact strips 210 for contact making and breaking therewith, and an actuator 240 with a compression coil spring 250. The contact lever 220 is supported at mid-length by a vertical central contact strip 230 for pivotal movement between two oppositely inclined positions, in either one of which the lever ends 221 come into contact with and out of contact from the respective adjacent fixed contact strip upper ends 211. The three strips 210 and 230 are fixed by being push-fitted laterally into respective horizontal bottom slots 123 of the side chamber 120 before the cover 129 is closed, with projecting ends acting as terminals of the switch 10.

During operation of the mechanism 200, switching is to take place between the central contact strip 230 (via the contact lever 220) and the two fixed contact strips 210 in opposite senses i.e. ON and OFF comparing one fixed contact strip 210 with the other.

The actuator 240 is an A-shaped integral structure having a horizontal cylindrical apex 241, a rear end pin 242 extending co-axially therefrom, and a pair of inclined legs 243 depending symmetrically from the apex 241. By its pin 242 being inserted through the partition hole 113, the actuator 240 is supported for pivotal movement about the pin 242. The contact lever 220 includes at mid-length an upwardly tee-off lug 222 positioned right below the actuator 240. The spring 250 is compressed and bent between the apex 241 and the lug 222, thereby resiliently biasing the contact lever 220 into either one of its inclined positions.

The actuator legs 243 are positioned on opposite sides of the contact lever lug 222, such that upon pivoting of the actuator 240 the forthcoming leg 243 will hit and press upon the lug 222 and thereby tilt the contact lever 220 to the opposite inclined position for switching. In doing so, the spring 250 flips rapidly over to the opposite side through an over-center action resiliently upon the contact lever 220.

The actuator pin 240 has a circular root section 240A and a square free-end section 240B. The circular pin section 240A fits rotatably snugly within the partition hole 113 by having a marginally smaller diameter, whereby a seal is formed between them that renders the partitioning between the central and the corresponding side chambers 110 and 120 substantially splash, jet or dust proof. The square pin section 240B extends beyond the partition hole 113 and engages angularly fixedly within an adjacent end of the square hole 312 of the rocker 300.

The two pins 240 from both actuators 240 are co-axially aligned with each other and are combined endwise to form a shaft for the rocker 300, engaging with the rocker 300 from opposite directions, about which shaft the actuators 240 and the rocker 300 are angularly movable.

Given its fixed engagement with both actuators 240, the rocker 300 may be pressed by a user to rock and thus pivot the actuators 240 at the same time, thereby simultaneously operating the two switching mechanisms 200.

The partitioning between the central and the side chambers 110 and 120 is made splash, jet or dust proof to meet, for example, the requirements as set out in International Electrotechnical Commission IEC 61058-1 (e.g. IP5X, IPX4 and IPX5). In use, the front, rocker side of the electrical switch 10 may be exposed to water splash/jet or dust which may enter the central chamber 110 but would be blocked from reaching into the side chambers 120 where the various electrical components are housed and switching takes place. Several small holes 115 in the casing side walls 112 allow escape of moisture from inside the central chamber 110.

The invention has been given by way of example only, and various modifications and/or variations to the described embodiment may be made by persons skilled in the art without departing from the scope of the invention as specified in the accompanying claims.

What is claimed is:

1. An electrical switch comprising:

a casing having a first chamber and at least one second chamber which are separated from each other by a partition;

a switching mechanism provided in the second chamber and comprising at least one fixed contact, a moving contact and an actuator for moving the moving contact into contact with and out of contact from the fixed contact;

an operator supported in the first chamber for angular movement between a first position causing the actuator to move the moving contact into contact with the fixed contact and a second position causing the actuator to move the moving contact out of contact from the fixed contact; and engaging means engaging the actuator to the operator for movement thereby, the engaging means including a circular part that extends across the first and second chambers rotatably snugly through a circular hole in the partition such that partitioning between the first and second chambers is substantially splash, jet or dust proof.

2. The electrical switch as claimed in claim 1, wherein the engaging means comprises a shaft which includes the circular part and fixedly inter-connects the actuator and the operator and about which the actuator and the operator are angularly movable.

3. The electrical switch as claimed in claim 1, wherein the engaging means comprises a shaft which includes the circular part and is an integral part of the actuator extending to and engaging with the operator, about which the actuator and the operator are angularly movable.

4. The electrical switch as claimed in claim 1, wherein the first chamber has an opening in which the operator is supported, the operator fully occupying the opening and thus closing the first chamber.

5. The electrical switch as claimed in claim 1, wherein the casing has a side wall that is recessed to define the second chamber.

6. The electrical switch as claimed in claim 5, wherein the second chamber is closed by a cover which is attached around its edge to the casing, thereby sealing off the second chamber.

7. The electrical switch as claimed in claim 1, wherein the casing has two said second chambers on opposite sides of the first chamber separated therefrom by respective said partitions and housing respective said switching mechanisms which are simultaneously operable by the operator.

8. The electrical switch as claimed in claim 7, wherein the casing has opposite side walls that are recessed to define the respective second chambers.

9. The electrical switch as claimed in claim 8, wherein the two partitions merges together in the lower half of the casing to form a single central wall between the two second chambers, on which the first chamber is located.

10. The electrical switch as claimed in claim 7, wherein the two actuators include respective pins as the engaging means which are co-axially aligned with each other and engage with the operator from opposite directions and about which the actuators and the operator are angularly movable.

11. The electrical switch as claimed in claim 1, wherein the switching mechanism comprises two said fixed contacts, and the moving contact comprises a contact lever extending across the fixed contacts for contact making and breaking therewith as pivoted by the actuator which acts upon the contact lever via a spring flippable by the actuator through an over-center action.

12. The electrical switch as claimed in claim 11, wherein the contact lever has a middle part acted upon by the spring, and the actuator includes two legs positioned on opposite sides of the lever part for pivotal movement to press upon the lever part and thereby tilt the contact lever in opposite directions.

13. The empirical switch as claimed in claim 1, being a rocker switch, wherein the operator comprises a rocker supported for pivotal movement.

* * * * *